US005779068A

United States Patent [19]

Whiten et al.

[11] Patent Number: 5,779,068

[45] Date of Patent: Jul. 14, 1998

[54] SUPPORT ASSEMBLY FOR DISPLAY SHELF

[75] Inventors: James Douglas Whiten, Kennesaw; J. Marshall Suttles, Elberton; Dennis E. Parham, Kennesaw; Reeder T. Burch, Jasper, all of Ga.

[73] Assignee: The Mead Corporation, Dayton, Ohio

[21] Appl. No.: 684,357

[22] Filed: Jul. 19, 1996

[51] Int. Cl.[6] ..... A47F 5/08

[52] U.S. Cl. ..... 211/117; 211/59.2; 211/207; 108/107; 248/328

[58] Field of Search ..... 211/113, 59.2, 211/117, 208, 209, 118; 193/15; 248/317, 328; 108/107, 149

[56] References Cited

U.S. PATENT DOCUMENTS

| | | | |
|---|---|---|---|
| 2,138,418 | 11/1938 | Fahrne | 211/59.2 |
| 2,218,444 | 10/1940 | Vineyard | 211/59.24 |
| 2,662,645 | 12/1953 | Piton | 312/248 |
| 2,743,838 | 5/1956 | Peterson | 211/113 |
| 4,401,121 | 8/1983 | Suttles | 211/49 |
| 4,405,052 | 9/1983 | Spiros | 211/187 |
| 5,279,430 | 1/1994 | Benton | 211/151 |

FOREIGN PATENT DOCUMENTS

| | | | |
|---|---|---|---|
| 3520197 | 12/1986 | Germany | 211/208 |
| 444805 | 2/1968 | Switzerland | 211/113 |

OTHER PUBLICATIONS

Photos marked (i)—(iii) are of a device observed in New York in Apr. 1996.

Photos marked (iv)—(vi) are of a track acquired by Applicant in Jun. 1996.

Set up Instructions for the HSB Neck Glide System—Mar. 1996.

*Primary Examiner*—Peter M. Cuomo
*Assistant Examiner*—Gerald A. Anderson
*Attorney, Agent, or Firm*—Tsugihiko Suzuki

[57] ABSTRACT

A support assembly for a display shelf, includes an upright for supporting the shelf in an elevated position, the upright having a plurality of slots disposed therealong at vertical spacings whereby the shelf may be supported at a selected elevation, an upper hook engaged with one of the slots of the upright, an elongate member connected to the upper hook and extending downward from the upper hook, a lower hook connected to the elongate member at the position lower than the upper hook to engage the shelf, and a spacer interposed between the upright and the lower hook to retain the lower hook at a predetermined position with respect to the upright.

16 Claims, 5 Drawing Sheets

SUPPORT ASSEMBLY FOR DISPLAY SHELF

BACKGROUND OF THE INVENTION

This invention relates to shelf devices for displaying thereon articles such as bottles, cans, bricks, cartons, bags or the like, and particularly to a support assembly for merchandising display shelves, which is capable of supporting shelves of different shapes and sizes.

Display shelf devices have been used both in warm and cold vaults to merchandise a number of products. An example of the shelf devices includes a plurality of shelves and a support frame on which the shelves are mounted in a tiered relationship. The support frame typically comprises four uprights in two rows, i.e., front and rear rows. Each upright is located at a certain distance from the adjacent upright so that the uprights are in an arrangement suitable for supporting the shelves of a particular shape and size.

In retail stores, it is common that the shelf devices are periodically replaced by new ones to promote different products or to redecorate the store interiors. However, replacement of those devices in cold vaults are not always easy. In some refrigerators, the support frames are built-in and thus are not replaceable. In other refrigerators such as walk-in coolers, the support frames are too large to readily handle within the crowded interior space. It would therefore be ideal if only the shelves could be replaced while the existing support frames are utilized. However, it is often difficult to adapt the existing support frames to replacement shelves that are not designed particularly for such support frames.

What is needed, therefore, is a shelf-mounting arrangement which facilitates mounting of replacement shelves of different shapes and sizes on existing support frames.

SUMMARY OF THE INVENTION

The present invention provides a support assembly for a display shelf. The assembly comprises an upright having a plurality of engaging means disposed therealong at vertical spacings, an upper hook engaged with one of the engaging means, an elongate member connected to the upper hook and extending downward from the upper hook, a lower hook connected to the elongate member at a position lower than the upper hook to engage the shelf, and positioning means interposed between the upright and the lower hook to retain the lower hook at a predetermined position with respect to the upright.

The support assembly of the invention is capable of supporting not only those shelves that can be disposed adjacent to the upright but also those having no choice but to be disposed relatively remote from the upright. The positioning means assists in locking the supported shelf in a particular position with respect to the upright and prevents swinging movement of the shelf.

One preferred form of the positioning means is a spacer rod extending between the upright and the lower hook. The spacer rod may be engaged at one of its ends with the upright at a position lower than the engaging means with which the upper hook is engaged. The other end of the spacer rod may be non-rotatably engageable with the shelf. Spacer rods of different lengths may be used depending on the desired location of the shelf with respect to the upright. In a preferred embodiment, the lower hook is horizontally spaced from the upright when in the predetermined position.

It is preferred that the elongate member is flexible and of good tensile strength. One preferred form of the elongate member is a chain formed of a plurality of link elements connected in series. Alternatively, the elongate member may be a wire, a metal rod, a cord including those each formed of woven or unwoven filaments of natural or synthetic material, or the like.

Each of the upper and lower hooks may be a double-ended hook such as a S-hook, a Z-hook, C-hook, I-hook or the like, or a single-ended hook such as a J-hook, a T-hook, a L-hook or the like. Single-ended hooks may be secured at their unhooked ends to the elongate member. However, double-ended hooks are preferred since they can be connected to a chain at any selected positions along the length of the chain.

Preferred forms of the engaging means include, but not limited to, slots, apertures, hooking projections provided for the upright.

The present invention also provides a merchandising device that comprises a display shelf for supporting articles, and front and rear opposed uprights supporting the shelf at an elevated position. Each upright has a plurality of engaging means disposed therealong at vertical spacings whereby the shelf may be supported at a selected elevation. The device further comprises front and rear joints connecting the shelf to the front and rear uprights respectively. At least one of the front and rear joints comprises an upper hook engaged with one of the engaging means of the respective upright, an elongate member connected to the upper hook and extending downward from the upper hook, and a lower hook engaged with said shelf and connected to the elongate member at a position lower than the upper hook.

In a preferred embodiment, each joint comprises the upper hook, the elongate member, and the lower hook. In such an embodiment, it is preferred that the front joint further comprises positioning means interposed between the front upright and the lower hook of the front joint to retain the lower hook of the front joint at a predetermined position with respect to the upright.

The present invention further provides a merchandising device for bottles each having an integrally formed annular neck flange. The device comprises an elongate track for supporting a row of bottles such that the bottles are suspended by the neck flanges for movement along the path defined by the track and are removable from the track through the forward end of the track, and rear stopper means provided at the rear end of the track for movement between opened and closed positions. In the opened position, the rear stopper means permits back-loading of bottles into the track through the rear end of the track. In the closed position, the rear stopper means prevents the trailing bottle from exiting the rear end.

The objects and advantages of the present invention will be apparent from the following description, the accompanying drawings and the appended claims.

DETAILED DESCRIPTION OF THE PREFERRED EMBODIMENT

Figure 1:
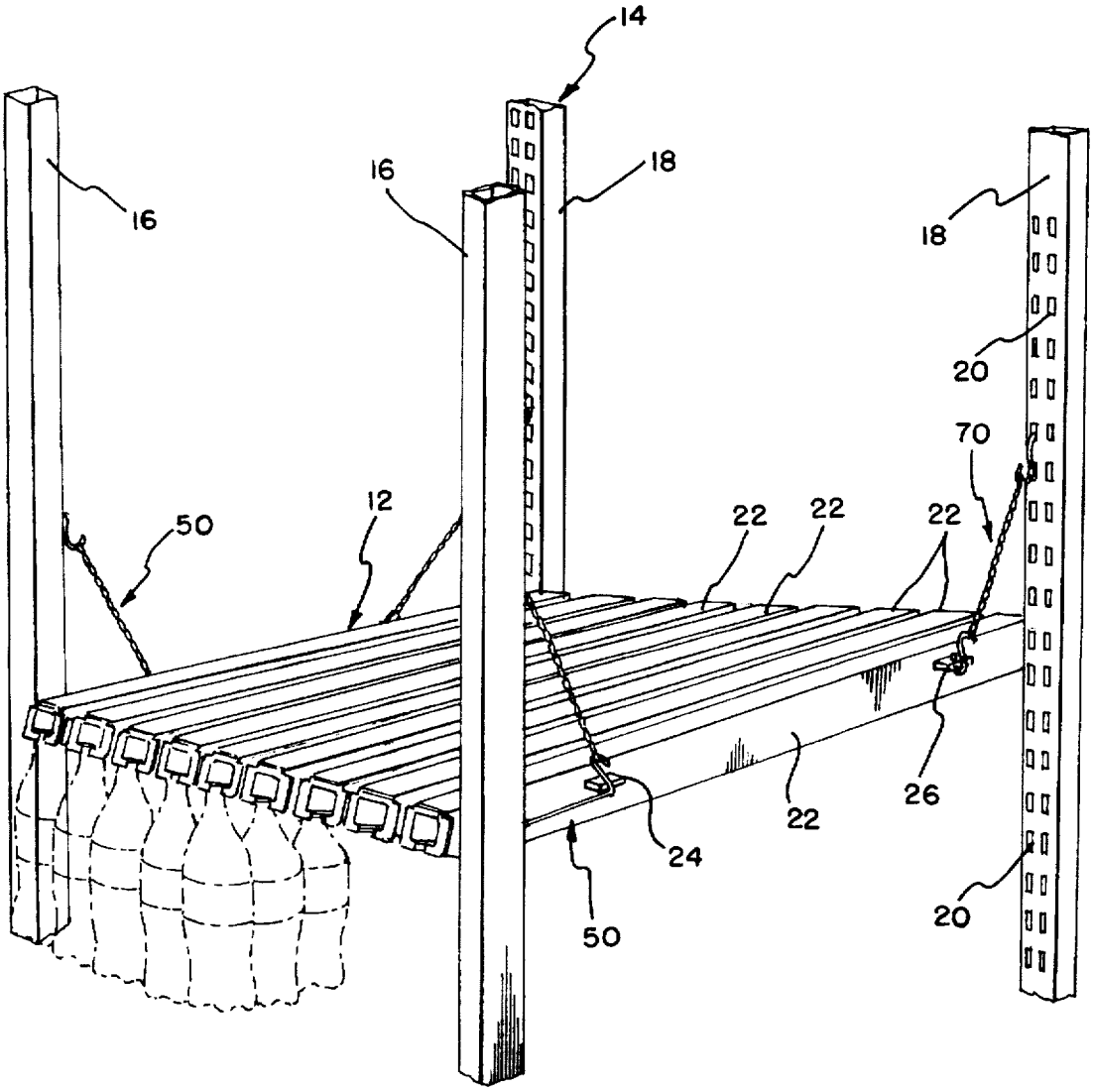
FIG. 1 is a perspective view of a merchandising device according to the invention.
Figure 2:
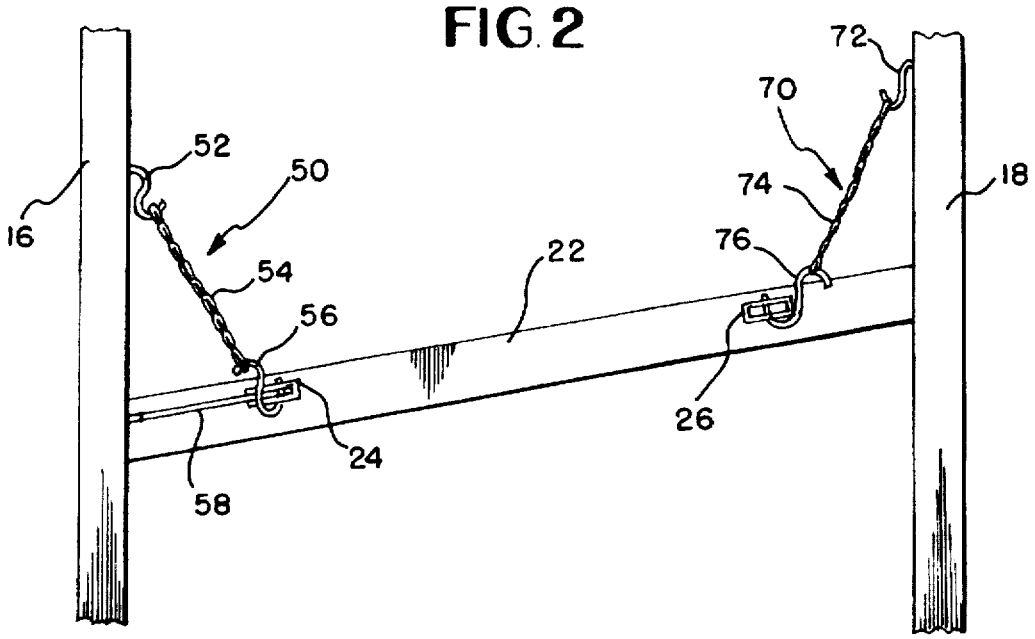
FIG. 2 is a side elevation of the merchandising device in FIG. 1.

FIG. 1 illustrates a merchandising device according to the invention. The illustrated device is a gravity feed device designed for dispensing bottles. The device includes one or more bottle display shelves 12 of the kind as shown in FIG. 1 removably mounted on a support assembly 14. The assembly 14 includes a support frame that is a conventional four-post rack having a pair of front uprights 16 and a pair of rear uprights 18. The device may have only one display shelf 12. However, it will in general have two or more display shelves 12 disposed in a tiered relationship.

The front and rear uprights 16 and 18 are interconnected by suitable transverse members (not shown) to form the support frame of a rigid construction. The four uprights 16 and 18 are of a substantially identical structure having a number of engaging means arranged vertically along themselves. More particularly, each upright is of a rectangular tube structure having the engaging means in the form of two vertical rows of slots 20. The front uprights 16 have the slots 20 formed in their respective rear walls (shown in FIG. 3) whereas the rear uprights 18 have them in their respective front walls. However, one vertical row of slots in each upright may be sufficient in most of the cases wherein the uprights are used as vertical support members for display shelves.

Figure 4:
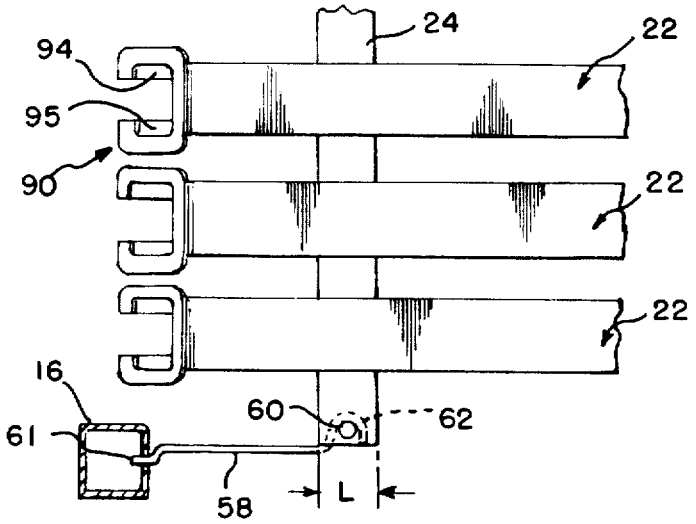
FIG. 4 is a plan view of the front joint in FIG. 3 with the front upright shown in a cross section.
Figure 6:
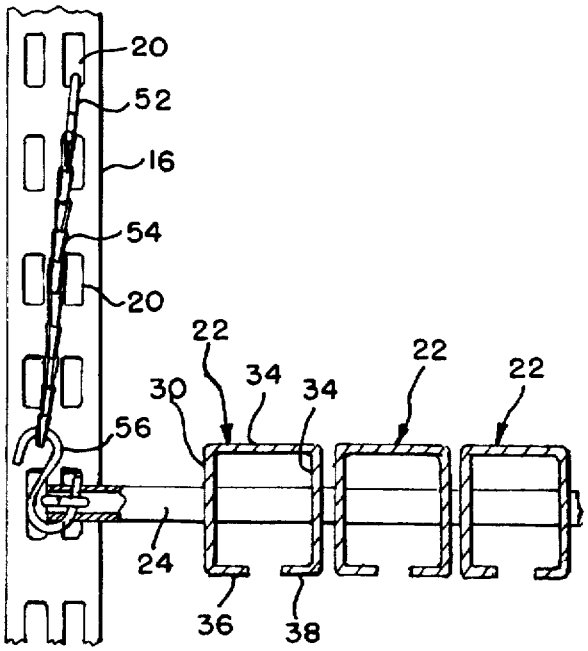
FIG. 6 is a rear view of the front joint in FIG. 3 with the front horizontal member and the tracks shown in cross sections.

The display shelf 12 includes a plurality of parallel tracks 22 having their forward ends disposed between the front uprights 16 and extending backward from the forward ends. As best shown in FIGS. 4 and 6, the tracks 22 are interconnected through a pair of front and rear horizontal support members 24 and 26 extending perpendicularly to the tracks 22. The tracks 22 are virtually identical to each other, and so are the front and rear transverse members 24 and 26.

Figure 3:
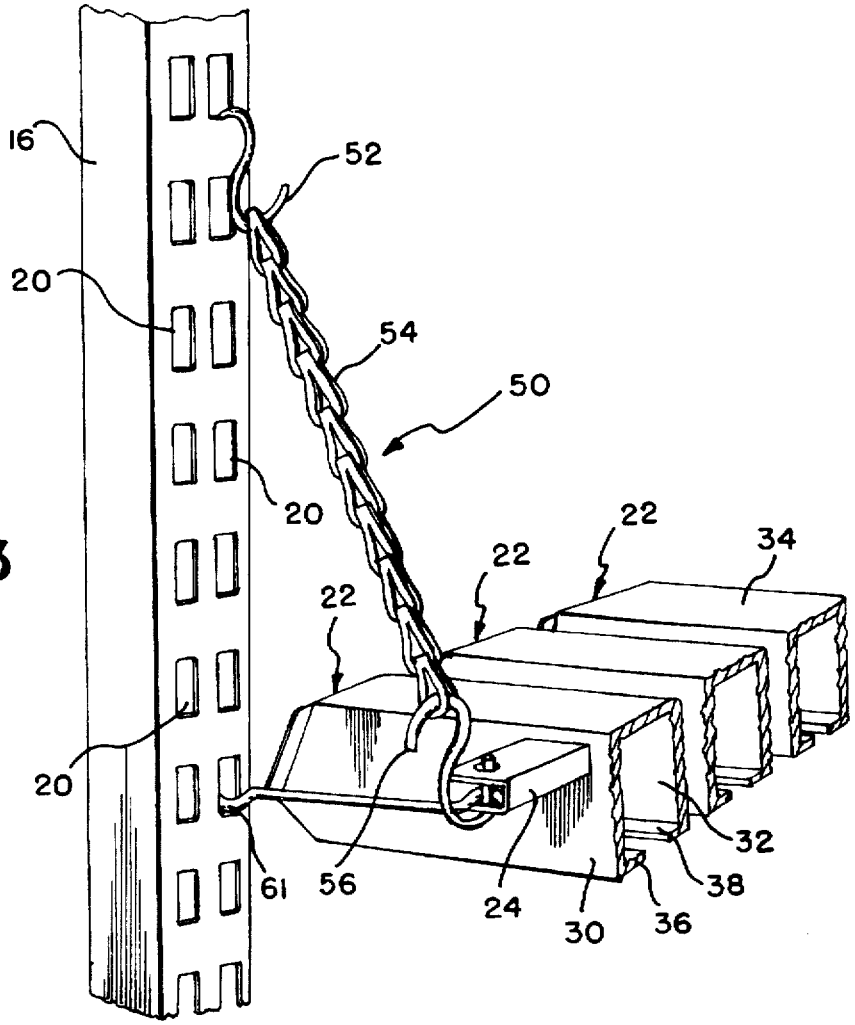
FIG. 3 is an enlarged perspective view of one of the front joints in FIG. 1.
Figure 7:
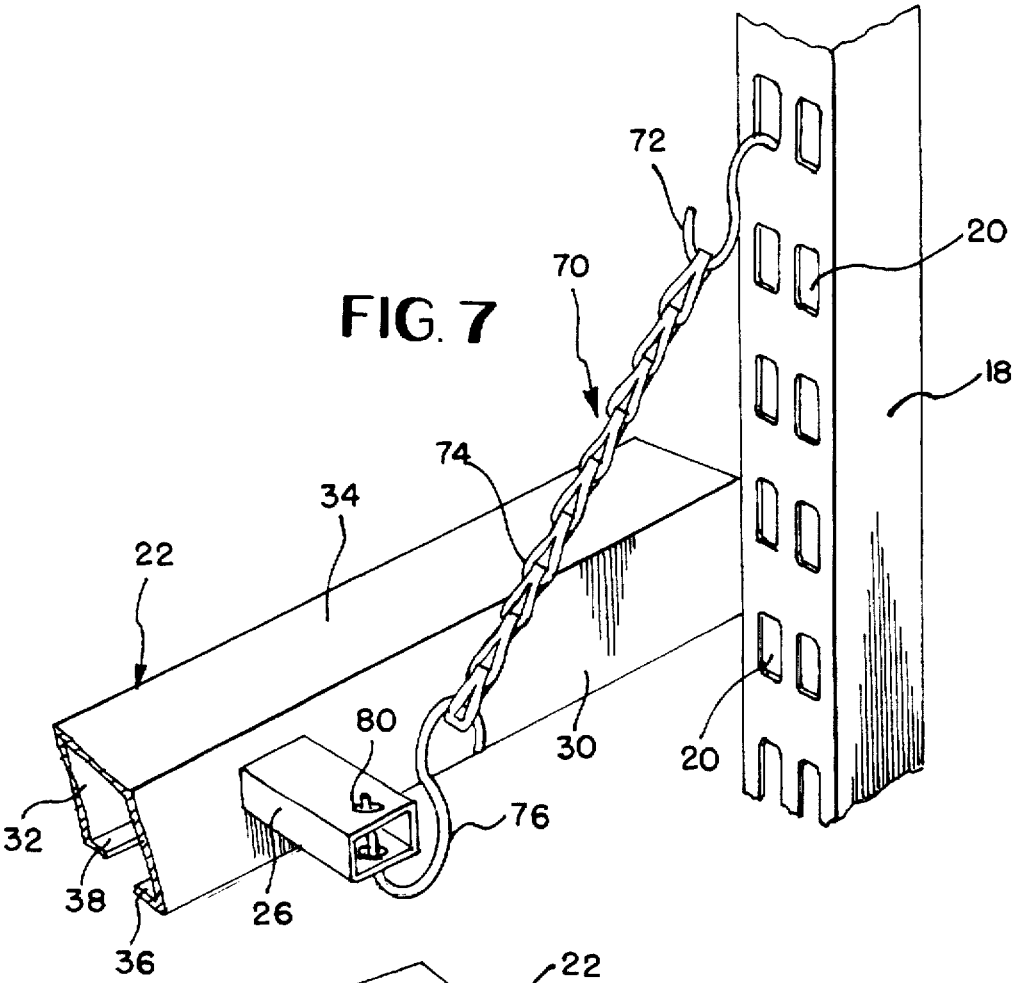
FIG. 7 is an enlarged perspective view of one of the rear joints in FIG. 1.

The tracks 22 are formed preferably of a metal plate or a molded plastic. As shown in FIGS. 3, 6 and 7, each track 22 has a pair of longitudinally extending opposed side walls 30 and 32 joined together along their upper edges by a top wall 34. The side walls 30 and 32 and the top wall 34 in cooperation form a channel structure having an inverted U-shaped cross section. A pair of parallel rails 36 and 38 are joined respectively along the lower edges of the side walls 30 and 32 so as to project inwardly of the track 22 toward each other. A space is maintained between the rails 36 and 38 to receive therein the necks of flanged bottles. The distance between the rails 36 and 38 is such that when bottle necks are received between the rails 36 and 38, the bottles are automatically arranged in a row and the undersides of the neck flanges engage the rails 36 and 38 to allow the bottles to be suspended for sliding movement along the respective track 22. When the tracks 22 are supported to incline to the forward ends, the suspended bottles gravity feed one after another to the forward end of each track 22 as the leading bottles on that track successively are removed from the track 22 through the forward end.

Typical flanged bottles used with the device of the invention may be soft drink bottles formed of plastic such as PET and having an integrally formed outwardly projecting annular flanges at their necks immediately under their caps. The bottles suspended from the tracks 22 are shown in dotted lines in FIG. 1. The detailed manner in which the bottles are suspended by their neck flanges is described in U.S. patent application Ser. No. 08/389,379, owned by the assignee of the present application, which is hereby incorporated by reference.

Figure 8:
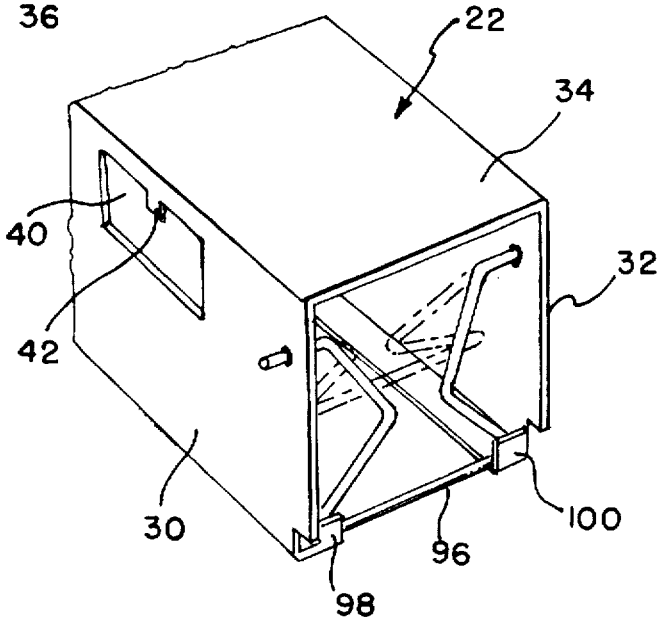
FIG. 8 is an enlarged perspective view of the rear end of one of the tracks in FIG. 1, showing the rear stopper means both in opened and closed positions.

The side walls 30 and 32 of each track 22 are provided at near each track end with a pair of opposed generally rectangular apertures 40 (only one shown in FIG. 8).

The forward end apertures 40 of each track 22 are identical in size and receive the front horizontal member 24 so that the forward end portion of that track 22 is supported by the member 24. The size of the forward end apertures 40 is such that the apertures 40 allow the associated track 22 to slide along the member 24.

The rear end apertures 40 of each track 22 are of the same size and receive the rear horizontal member 26 so that the rear end portion of that track 22 is supported by the member 26. The rear end apertures 40 also allow the associated track 22 to slide along the member 26.

As shown in FIG. 8, a tab 42 projects downwardly from the perimeter of each of the forward and rear end apertures 40. These tabs 42 are provided to be received in recesses or openings (not shown) in the horizontal members 24 and 26 to lock the tracks 22 in selected positions on the members 24 and 26.

The front horizontal member 24 is of a rectangular tube structure formed of metal or plastic. It passes transversely through all the tracks 22 in the shelf 12 as best shown in FIG. 6. The opposite ends of the horizontal member 24 are detachably mounted on the front uprights 16 by means of a pair of front joints 50 constituting a part of the support assembly 14.

As best shown in FIGS. 3, each front joint 50 includes an upper hook in the form of a S-hook 52, an elongate member in the form of a chain 54, a lower hook in the form of another S-hook 56, and positioning means in the form of a spacer rod 58. The upper hook 52 is engaged at its upper end with one of the engaging slots 20 of the associated front upright 16. The chain 54 is connected to the lower end of the upper hook 52 and extended downward and backward from the upper hook 52. The lower hook 56 is connected to the lower end of the chain 54 and is engaged with the associated end of the front horizontal member 24. To facilitate engagement of the lower hook 56 with the horizontal member 24, the member 24 is provided at each end thereof with openings 60 for receiving the lower end of the lower hook 56. Such openings 60 are formed respectively in the upper and lower walls of the member 24 so that the lower hook 56 is inserted into both the openings 60 to ensure the engagement.

Figure 5:
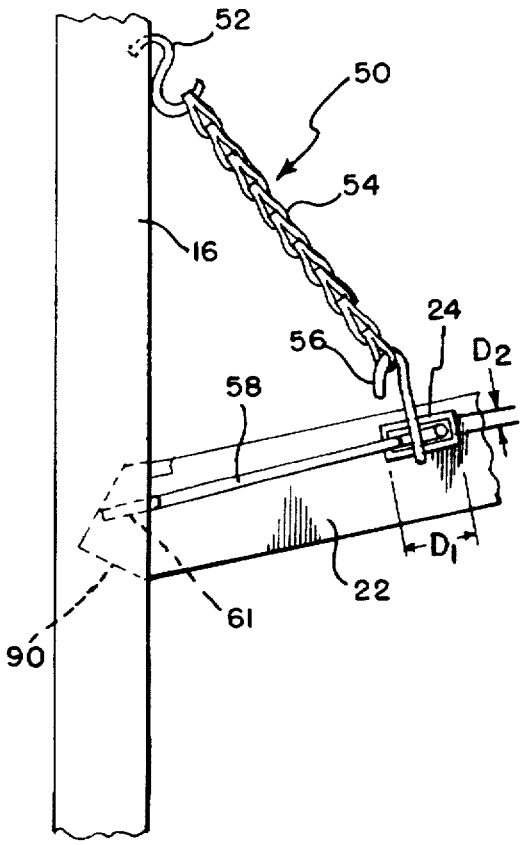
FIG. 5 is a side elevation of the front joint in FIG. 3.

The spacer rod 58 of each front joint 50 is interposed between the associated front upright 16 and the lower hook 56. As best shown in FIG. 4, the rod 58 is received at its L-shaped end 61 in one of the front slots 20 positioned lower than the upper S-hook 52 and extends backward to the U-shaped end 62 which is received in the horizontal member 24. The longitudinal size "L" (shown in FIG. 4) of the U-shaped end 62 is slightly smaller than or equal to the larger inner dimension "D1" (shown in FIG. 5) of the rectangular member 24 whereas it is greater than the shorter inner dimension "ID2" (shown in FIG. 5) of the member 24. This dimensional arrangement provides non-rotatable connection between the horizontal member 24 and the spacer rod 58 and prevents horizontal and vertical movement of the rod 58 about the U-shaped end 62.

In particular, the spacer rod 58 retains the associated lower hook 56 at a position horizontally spaced backwardly from the associated upright 16. This, in turn, assures that the forward ends of the tracks 22 are retained at a predetermined position with regard to the associated front upright 16. For example, in case the front uprights 16 are fixedly installed in a refrigerator at a position near the refrigerator door, the position of the track forward ends can be adjusted according to the invention so that the forward ends do not interfere with the door. Spacer rods of different lengths may, of course, be used to adjust the shelf end position.

The rear horizontal member 26 is also of a rectangular tube structure formed of metal or plastic. It passes transversely through all the tracks 22 in the shelf 12. The opposite ends of the horizontal member 26 are detachably mounted on the rear uprights 18 by means of a pair of rear joints 70 constituting a part of the assembly 14.

As best shown in FIGS. 7, each rear joint 70 includes an upper hook in the form of a S-hook 72, an elongate member in the form of a chain 74, and a lower hook in the form of another S-hook 76. No positioning means is used in the rear joints 70 to leave the position of the lower hook 76 adjustable with respect to the associated rear upright 18. The shelf end position is to be controlled solely by means of the spacer rods 58 in the front joints 50. The upper hook 72 of each rear joint 70 is engaged at its upper end with one of the engaging slots 20 of the associated rear upright 18. The chain 74 is connected to the lower end of the upper hook 72 and extended downward and forward from the upper hook 72. The lower hook 76 is connected to the lower end of the chain 74 and is engaged with the associated end of the rear horizontal member 26. The rear horizontal member 26 is also provided at each end thereof with openings 80 for receiving the lower end of the lower hook 76. Such openings 80 are formed respectively in the upper and lower walls of the member 26 so that the lower hook 76 is inserted into both the openings 80 to ensure the engagement.

The slots 20 of the uprights 16 and 18 with which the upper hooks 52 and 72 are engaged are selected such that each of the front and rear members 24 and 26 is held substantially horizontally while the rear horizontal member 26 is supported at the position higher than the front horizontal member 24. Alternatively, the effective lengths of the chains 54 and 74 are adjusted by selecting the link elements of the chains 54 and/or 74 to which either the upper hooks or the lower hooks are connected. Such an arrangement permits the tracks 22 to be inclined downwardly toward their respective forward ends. The angle of inclination of the tracks from the horizontal may be about 1 to 20 degrees, preferably about 2 to 18 degrees and most preferably about 7 to 9 degrees. The inclination of the tracks 22 allows the bottles on the tracks to gravity feed to the forward ends of the tracks as the leading bottles on each track are removed successively from that track.

Each track 22 is provided with a front stopper 90 at its forward end. The front stopper 90 comprises a length of the respective track 22 adjacent to the forward end. Such a length is upturned relative to the immediately preceding length of the track 22 to provide forwardly upwardly sloping portions 92 and 94 (shown in FIG. 4) of the rails 36 and 38. When the leading bottles in each track 22 travel along the sloping portions 92 and 94, they are braked to a stop and presented for removal from the track 22. The upturned length of the track 22 may be formed integrally with the track 22 or it may be provided as a separate replaceable portion.

Further, each track 22 is provided at its rear end with a rear stopper. In FIG. 8, the rear stopper is shown in the form of a wire gate 96 which is pivotally connected to the side walls 30 and 32 of the respective track 22 for movement between an opened position and a closed position. The closed position is shown in the solid line in which the wire gate 96 is disposed vertically and abuts the inside surfaces of a pair of stop elements 98 and 100 extending inwardly from the side walls 30 and 32. The wire gate 96 is normally held in the closed position due to the gravity and is restrained from pivoting backward due to the stop elements 98 and 100. This prevents the trailing bottle on the respective track 22 from accidentally exiting the rear end of the track 22. However, the wire gate 96 is free to pivot forward as shown in the phantom line until it comes into abutment with the top wall 34. Thus, it permits back-loading of bottles into the respective track 22 through the rear end.

Figure 9:
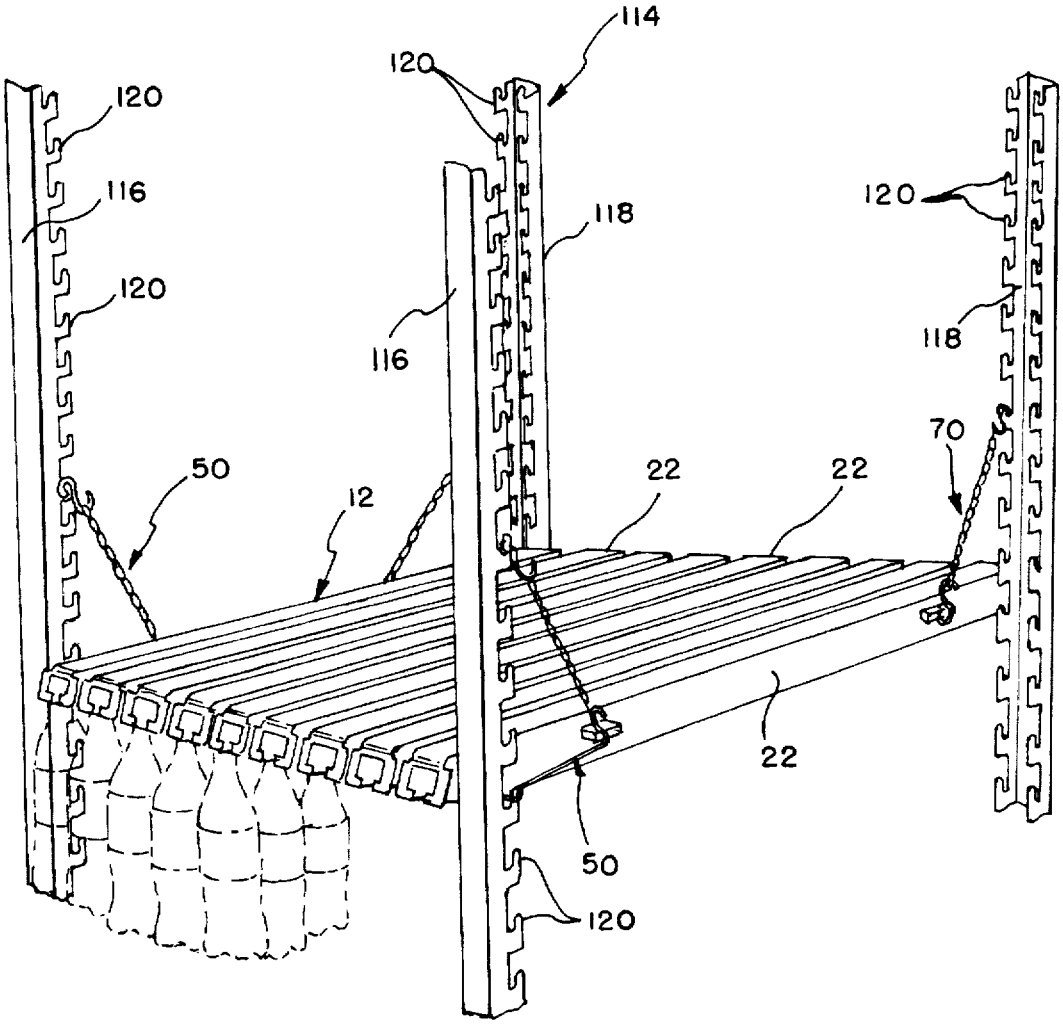
FIG. 9 is a perspective view of another embodiment of a merchandising device according to the present invention.

It will be recognized that many variations may be made to the foregoing within the scope of the present invention. For example, a rear stopper hinged to the top wall 34 may be used instead of the stopper 96. The slots 20 may be formed in the rear wall of each rear upright to allow the associated elongate member to extend downward and backward rather than downward and forward. Further, alternative support assembly may be used. An example of alternative assembly is illustrated in FIG. 9 wherein the assembly 114 includes a plurality of hooking portions 120 formed on each of front and rear uprights 116 and 118. These portions 120 are arranged in two vertical rows in which they are disposed at equal vertical spacings. The display shelf and the front and rear joints used in FIG. 9 are identical respectively to the shelf 12 and the joints 50 and 70 in FIG. 1 and thus like reference numerals are used to indicate the corresponding portions.

It should be also recognized that not only the gravity feed display shelves of the type described above but also shelves of any other types may be mounted on the support assembly according to the present invention. For example, horizontal shelves for supporting articles on their upper surfaces may be mounted on the above-described support assembly. To support such horizontal shelves, any suitable engageable means such as apertures or hooks may be provided on the shelves to engage with the lower hooks 56 and 76.

It should be further recognized that the support assembly of the invention is capable of supporting not only those shelves specially designed for the support assembly but also those different in shape and size from the specially designed shelves as well as those having the engageable means at locations mismatching the uprights. For example, the shelf 12 in the above embodiment has the engageable means 24 and 26 at the mismatching location in the sense that there is no way to locate both the members 24 and 26 adjacent respectively to the front and rear uprights 16 and 18 unless the uprights 16 and 18 or the members 24 and 26 are relocated. The location along a track that is most desirable for a front horizontal member would not be available for the front member when, for example, the forward end portion of the track is occupied by a gate mechanism such as described in U.S. patent application Ser. No. 08/389,379 owned by the assignee of the invention, which is hereby incorporated by reference. However, the assembly of the invention is capable of supporting such different or mismatching shelves.

What is claimed is:

1. A support assembly for a display shelf, comprising:

an upright for supporting said shelf in an elevated position, said upright having a plurality of engaging means disposed therealong at vertical spacings whereby said shelf may be supported at a selected elevation;

an upper hook engaged with one of said engaging means of said upright;

an elongate member connected to said upper hook and extending downward from said upper hook;

a lower hook connected to said elongate member at a position lower than said upper hook to engage said shelf; and positioning means interposed between said upright and said lower hook to retain said lower hook at a predetermined position with respect to said upright.

2. The support assembly according to claim 1, wherein said positioning means comprises a spacer extending between said upright and said lower hook.

3. The support assembly according to claim 2, wherein said spacer has one and the other opposite ends, said one end being engaged with said upright at a position lower than said one engaging means, said other end being non-rotatably engageable with said shelf.

4. The support assembly according to claim 1, wherein said lower hook is horizontally spaced from said upright when in said predetermined position.

5. The support assembly according to claim 1, wherein said elongate member comprises a chain formed of a plurality of link elements connected in series, and each of said upper and lower hooks is a S-hook so that said each hook may be connected to said chain at a selected position along a length of said chain.

6. The support assembly according to claim 1, wherein said plurality of engaging means comprises a plurality of slots formed in said upright.

7. The support assembly according to claim 1, wherein said plurality of engaging means comprises a plurality of hooking portions formed on said upright.

8. A merchandising device comprising:

a display shelf for supporting articles;

front and rear opposed uprights for supporting said shelf in an elevated position, each of said uprights having a plurality of engaging means disposed therealong at vertical spacings whereby said shelf may be supported at a selected elevation; and front and rear joints connecting said shelf to said front and rear uprights respectively, each of said front and rear Joints comprising an upper hook engaged with one of said engaging means of a respective one of said uprights, an elongate member connected to said upper hook and extending downward from said upper hook, and a lower hook connected to said elongate member at a position lower than said upper hook and engaged with said shelf, said front joint further comprising positioning means interposed between said front upright and said lower hook of said front joint to retain said lower hook of said front joint at a predetermined position with respect to said front upright.

9. The device according to claim 8, wherein said shelf has a forward end disposed near said front upright, said lower hook of said front joint when in said predetermined position is disposed between said front and rear uprights with a horizontal space from said front upright, and said positioning means comprises a spacer extending backward from said front upright to said lower hook of said front joint to retain said lower hook at said predetermined position whereby said forward end of said shelf is held in a fixed location with respect to said front upright.

10. The device according to claim 9, wherein said shelf is inclined downwardly toward said forward end thereof.

11. The device according to claim 9, wherein said shelf comprises a horizontal member extending generally perpendicularly to said front upright, said horizontal member being engaged at one end thereof with said lower hook of said front joint, and said spacer has one and the other opposite ends, said one end being engaged with said front upright at a position lower than said one engaging means, said other end being non-rotatably engaged with said one end of said horizontal member.

12. The device according to claim 9, wherein said lower hook of said rear joint is disposed between said rear upright and said lower hook of said front joint with a horizontal space from said rear upright.

13. A merchandising device comprising:

a display shelf including an elongate track having a forward end and a rear end to support a row of articles such that said articles are movable along a Path defined by said track, and front and rear opposed horizontal members extending generally perpendicularly to said track;

front and rear opposed uprights for supporting said shelf in an elevated position, each of said uprights having a plurality of engaging slots disposed therealong at vertical spacings whereby said shelf may be supported at a selected elevation; and front and rear joints connecting said front and rear horizontal members to said front and rear uprights respectively such that said rear horizontal member is supported at a position higher than said front horizontal member to allow said shelf to be inclined downwardly toward said forward end whereby said articles when supported by said track are allowed to gravity feed toward said forward end along said path, at least one of said front and rear joints comprising an upper hook selectively encased with one of said slots of a respective one of said uprights, a flexible elongate member connected to said upper hook and extending downward from said upper hook, and a lower hook connected to said elongate member at a position lower than said upper hook and engaged with a respective one of said horizontal members of said shelf, whereby said shelf may be inclined at a selected angle with respect to the horizontal, wherein said at least one joint comprises each of said front and rear joints, and said front joint further comprises positioning means having one and the other opposite ends, said one end of said positioning means being engaged with said front upright, said other end of said positioning means being non-rotatably engaged with said one end of said front horizontal member.

14. The device according to claim 13, wherein said shelf is inclined at about 1 to 20 degrees with respect to the horizontal.

15. The device according to claim 13, wherein said respective horizontal member is provided at one end thereof with an opening for engaging said lower hook of said at least one joint.

16. The device according to claim 13, wherein said elongate member of said at least one joint is a chain formed of a plurality of link elements connected in series, and each of said upper and lower hooks of said at least one joint is a S-hook so that said each hook of said at least one joint may be connected to said chain of said at least one joint at a selected position along a length thereof.

* * * * *